United States Patent [19]

DeCristofaro et al.

[11] 4,219,355

[45] Aug. 26, 1980

[54] IRON-METALLOID AMORPHOUS ALLOYS FOR ELECTROMAGNETIC DEVICES

[75] Inventors: Nicholas J. DeCristofaro, Chatham; Alfred Freilich, Livingston; Davidson M. Nathasingh, Parsippany, all of N.J.

[73] Assignee: Allied Chemical Corporation, Morris Township, Morris County, N.J.

[21] Appl. No.: 42,472

[22] Filed: May 25, 1979

[51] Int. Cl.[2] ..... C22C 1/00; C22C 19/00; C22C 31/00; C22C 39/00

[52] U.S. Cl. ..... 75/123 B; 75/123 L; 148/103

[58] Field of Search ..... 75/123 B, 123 L; 148/103

[56] References Cited

U.S. PATENT DOCUMENTS 3,856,513 12/1974 Chen et al. ..... 75/124

*Primary Examiner*—L. Dewayne Rutledge
*Assistant Examiner*—Upendra Roy
*Attorney, Agent, or Firm*—Gerhard H. Fuchs

[57] ABSTRACT

An amorphous metal alloy which is at least 90% amorphous having enhanced magnetic properties and consisting essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100.

5 Claims, No Drawings

IRON-METALLOID AMORPHOUS ALLOYS FOR ELECTROMAGNETIC DEVICES

DESCRIPTION

1. Field of the Invention

The invention relates to amorphous metal alloy compositions and, in particular, to amorphous alloys containing iron, boron, silicon and carbon having enhanced D.C. and A.C. magnetic properties.

2. Description of the Prior Art

Investigations have demonstrated that it is possible to obtain solid amorphous materials from certain metal alloy compositions. An amorphous material substantially lacks any long range atomic order and is characterized by an X-ray diffraction profile consisting of broad intensity maxima. Such a profile is qualitatively similar to the diffraction profile of a liquid or ordinary window glass. This is in contrast to a crystalline material which produces a diffraction profile consisting of sharp, narrow intensity maxima.

These amorphous materials exist in a metastable state. Upon heating to a sufficiently high temperature, they crystallize with evolution of the heat of crystallization, and the X-ray diffraction profile changes from one having amorphous characteristics to one having crystalline characteristics.

Novel amorphous metal alloys have been disclosed by H. S. Chen and D. E. Polk in U.S. Pat. No. 3,856,513, issued Dec. 24, 1974. These amorphous alloys have the formula $M_aY_bZ_c$ where M is at least one metal selected from the group of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent. These amorphous alloys have been found suitable for a wide variety of applications in the form of ribbon, sheet, wire, powder, etc. The Chen and Polk patent also discloses amorphous alloys having the formula $T_iX_j$, where T is at least one transition metal, X is at least one element selected from the group consisting of aluminum, antimony, beryllium, boron, germanium, carbon, indium, phosphorus, silicon and tin, "i" ranges from about 70 to 87 atom percent and "j" ranges from about 13 to 30 atom percent. These amorphous alloys have been found suitable for wire applications.

At the time that the amorphous alloys described above were discovered, they evidenced magnetic properties that were superior to then known polycrystalline alloys. Nevertheless, new applications requiring improved magnetic properties and higher thermal stability have necessitated efforts to develop additional alloy compositions.

SUMMARY OF THE INVENTION

In accordance with the present invention, there is provided a metal alloy which is at least 90% amorphous consisting essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100.

The subject alloys are at least 90% amorphous and preferably at least 97% amorphous, and most preferably 100% amorphous, as determined by X-ray diffraction. The alloys are fabricated by a known process which comprises forming a melt of the desired composition and quenching at a rate of at least about $10^{5°}$ C./sec. by casting molten alloy onto a rapidly rotating chill wheel.

In addition, the invention provides a method of enhancing the magnetic properties of a metal alloy which is at least 90% amorphous consisting essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100, which method comprises the step of annealing the amorphous metal alloy.

Further, the invention provides a core for use in an electromagnetic device; such core comprising a metal alloy which is at least 90% amorphous consisting essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100.

The alloys of this invention exhibit improved A.C. and D.C. magnetic properties thar remain stable at temperatures up to about 150° C. As a result, the alloys are particularly suited for use in power transformers, aircraft transformers, current transformers, 400 Hz transformers, switch cores, high gain magnetic amplifiers and low frequency inverters.

DETAILED DESCRIPTION OF THE INVENTION

The composition of the new amorphous Fe-B-Si-C alloy, in accordance with the invention, consists of 80 to 82 atom percent iron, 12.5 to 14.5 atom percent boron, 2.5 to 5.0 atom percent silicon and 1.5 to 2.5 atom percent carbon. Such compositions exhibit enhanced D.C. and A.C. magnetic properties. The improved magnetic properties are evidenced by high magnetization, low core loss and low volt-ampere demand. A preferred composition within the foregoing ranges consists of 81 atom percent iron, 13.5 atom percent boron, 3.5 atom percent silicon and 2 atom percent carbon.

The alloys of the present invention are at least about 90% amorphous and preferably at least about 97% amorphous and most preferably 100% amorphous. Magnetic properties are improved in alloys possessing a greater volume percent of amorphous material. The volume percent of amorphous material is conveniently determined by X-ray diffraction.

The amorphous metal alloys are formed by cooling a melt at a rate of about $10^{5°}$ to $10^{6°}$ C./sec. The purity of all materials is that found in normal commercial practice. A variety of techniques are available for fabricating splat-quenched foils and rapid-quenched continuous ribbons, wire, sheet, etc. Typically, a particular composition is selected, powders or granules of the requisite elements (or of materials that decompose to form the elements, such as ferroboron, ferrosilicon, etc.) in the desired porportions are melted and homogenized, and the molten alloy is rapidly quenched on a chill surface, such as a rotating cylinder.

The alloys of the present invention have an improved processability as compared to other iron-based metallic glasses, since the subject alloys demonstrate a minimized melting point and maximized undercooling.

The magnetic properties of the subject alloys can be enhanced by annealing the alloys. The method of annealing generally comprises heating the alloy to a temperature sufficient to achieve stress relief but less than that required to initiate crystallization, cooling the alloy, and applying a magnetic field to the alloy during the heating and cooling. Generally, a temperature range of about 340° C. to 385° C. is employed during heating, with temperatures of about 345° C. to 380° C. being preferred. A rate of cooling range of about 0.5° C./min. to 75° C./min. is employed, with a rate of about 1° C./min. to 16° C./min. being preferred.

As discussed above, the alloys of the present invention exhibit improved magnetic properties that are stable at temperatures up to about 150° C., rather than a maximum of 125° C. as evidenced by prior art alloys. The increased temperature stability of the present alloys allows utilization thereof in high temperature applications, such as cores in transformers for distributing electrical power to residential and commercial consumers.

When cores comprising the subject alloys are utilized in electromagnetic devices, such as transformers, they evidence high magnetization, low core loss and low volt-ampere demand, thus resulting in more efficient operation of the electromagnetic device. The loss of energy in a magnetic core as the result of eddy currents, which circulate through the core, results in the dissipation of energy in the form of heat. Cores made from the subject alloys require less electrical energy for operation and produce less heat. In applications where cooling apparatus is required to cool the transformer cores, such as transformers in aircraft and large power transformers, an additional savings is realized since less cooling apparatus is required to remove the smaller amount of heat generated by cores made from the subject alloys. In addition, the high magnetization and high efficiency of cores made from the subject alloys result in cores of reduced weight for a given capacity rating.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES

Toroidal test samples were prepared by winding approximately 0.030 kg of 0.0254 m wide alloy ribbon of various compositions containing iron, boron, silicon and carbon on a steatite core having inside and outside diameters of 0.0397 m and 0.0445 m, respectively. One hundred and fifty turns of high temperature magnetic wire were wound on the toroid to provide a D.C. circumferential field of 795.8 ampere/meter for annealing purposes. The samples were annealed in an inert gas atmosphere for 2 hours at 365° C. with the 795.8 A/m field applied during heating and cooling. The samples were cooled at rates of 1° C./min. and 16° C./min.

The D.C. magnetic properties, i.e., coercive force ($H_c$) and remanent magnetization at zero (A/m ($B_{(0)}$) and at eighty A/m ($B_{(80)}$), of the samples were measured by a hysteresisgraph. The A.C. magnetic properties, i.e., core loss (watts/kilogram) and RMS volt-ampere demand (RMS volt-amperes/kilogram), of the samples were measured at a frequency of 60 Hz and a magnetic intensity of 1.26 tesla by the sine-flux method.

Field annealed D.C. and A.C. magnetic values for a variety of alloy compositions that are within the scope of the present invention are shown in Table I.

Table I

FIELD ANNEALED D.C. AND A.C. MAGNETIC MEASUREMENTS FOR AMORPHOUS METAL ALLOYS WITHIN THE SCOPE OF THE INVENTION

| | Composition | | | | D.C. | | | 60 Hz | |
|---|---|---|---|---|---|---|---|---|---|
| | Fe | B | Si | C | Hc | $B_{(0)}$ | $B_{(80)}$ | A.C. 1.26 T | |
| | (atom %) | | | | | | | | |
| Ex. | (weight %) | | | | (A/m) | (T) | (T) | w/kg | VA/kg |
| 1 | 81.0 | 13.0 | 4.0 | 2.0 | 4.0 | 1.40 | 1.56 | 0.19 | 0.29 |
| | 94.2 | 2.9 | 2.4 | 0.5 | | | | | |
| 2 | 80.8 | 12.8 | 4.2 | 2.2 | 4.0 | 1.40 | 1.54 | 0.22 | 0.29 |
| | 94.0 | 2.9 | 2.5 | 0.6 | | | | | |
| 3 | 80.1 | 13.3 | 4.6 | 2.0 | 3.2 | 1.38 | 1.52 | 0.31 | 0.35 |
| | 93.8 | 3.0 | 2.7 | 0.5 | | | | | |
| 4 | 80.5 | 14.3 | 2.7 | 2.5 | 3.2 | 1.26 | 1.46 | 0.32 | 0.79 |
| | 94.5 | 3.3 | 1.6 | 0.6 | | | | | |
| 5 | 81.0 | 13.2 | 3.9 | 1.9 | 4.8 | 1.22 | 1.48 | 0.24 | 0.79 |
| | 94.2 | 3.0 | 2.3 | 0.5 | | | | | |
| 6 | 81.9 | 13.7 | 2.7 | 1.7 | 7.2 | 1.20 | 1.52 | 0.24 | 0.29 |
| | 94.9 | 3.1 | 1.6 | 0.4 | | | | | |

For comparison, the compositions of some amorphous metal alloys lying outside the scope of the invention and their field annealed D.C. and A.C. measurements are listed in Table II. These alloys, in contrast to those within the scope of the present invention, evidenced low magnetization, high core loss and high volt-ampere demand.

Table II

FIELD ANNEALED D.C. AND A.C. MAGNETIC MEASUREMENTS FOR AMORPHOUS METAL ALLOYS NOT WITHIN THE SCOPE OF THE INVENTION

| | Composition | | | | D.C. | | | 60 Hz | |
|---|---|---|---|---|---|---|---|---|---|
| | Fe | B | Si | C | Hc | $B_{(O)}$ | $B_{(80)}$ | A.C. | 1.26 T |
| | (atom %) | | | | | | | | |
| Ex. | (weight %) | | | | (A/m) | (T) | (T) | w//kg | VA/kg |
| 7 | 81.0 | 2.0 | 6.0 | 1.0 | 4.8 | 0.98 | 1.27 | 0.29 | 3.53 |
| | 93.6 | 2.7 | 3.5 | 0.2 | | | | | |
| 8 | 80.0 | 10.0 | 5.0 | 5.0 | 4.8 | 0.78 | 0.96 | 0.35 | 5.28 |
| | 93.5 | 2.3 | 2.9 | 1.3 | | | | | |
| 9 | 83.3 | 12.3 | 2.6 | 1.8 | 18.4 | 0.07 | 0.28 | 0.73 | 22.22 |
| | 95.3 | 2.8 | 1.5 | 0.4 | | | | | |
| 10 | 83.5 | 13.5 | 0.8 | 2.2 | 11.2 | 0.20 | 0.60 | 0.35 | 11.31 |
| | 96.0 | 3.0 | 0.5 | 0.5 | | | | | |
| 11 | 77.5 | 12.0 | 8.3 | 2.2 | 4.8 | 1.06 | 1.30 | 0.24 | 1.47 |
| | 91.7 | 2.8 | 4.9 | 0.6 | | | | | |
| 12 | 82.0 | 15.0 | 3.0 | 0.0 | 4.0 | 0.62 | 0.97 | 0.33 | 3.30 |
| | 94.9 | 3.4 | 1.7 | 0.0 | | | | | |

We claim:

1. A metal alloy which is at least 90% amorphous consisting essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100.

2. An amorphous metal alloy as recited in claim 1, wherein said alloy is at least about 97 percent amorphous.

3. An amorphous metal alloy as recited in claim 1, wherein said alloy is 100 percent amorphous.

4. An amorphous metal alloy as recited in claim 1, wherein "a", "b", "c" and "d" are 81, 13.5, 3.5 and 2, respectively.

5. A core for use in an electromagnetic device comprising a metal alloy which is at least 90% amorphous consisting essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100.

* * * * *